US011384993B2

(12) United States Patent
Kurashima et al.

(10) Patent No.: US 11,384,993 B2
(45) Date of Patent: Jul. 12, 2022

(54) HEAT PIPE

(71) Applicant: SHINKO ELECTRIC INDUSTRIES CO., LTD., Nagano (JP)

(72) Inventors: Nobuyuki Kurashima, Nagano (JP); Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 323 days.

(21) Appl. No.: 16/426,173

(22) Filed: May 30, 2019

(65) Prior Publication Data

US 2019/0277574 A1 Sep. 12, 2019

Related U.S. Application Data

(62) Division of application No. 15/807,797, filed on Nov. 9, 2017, now Pat. No. 10,352,626.

(30) Foreign Application Priority Data

Dec. 14, 2016 (JP) ..... JP2016-242730
Jun. 7, 2017 (JP) ..... JP2017-112587

(51) Int. Cl.
*F28D 15/04* (2006.01)
*F28D 15/02* (2006.01)
(Continued)

(52) U.S. Cl.
CPC ..... *F28D 15/046* (2013.01); *F28D 15/02* (2013.01); *F28D 15/0233* (2013.01);
(Continued)

(58) Field of Classification Search
CPC .... F28D 15/04; F28D 15/046; F28D 15/0233; F28D 15/02; F28D 15/043
See application file for complete search history.

(56) References Cited

U.S. PATENT DOCUMENTS 3,566,514 A * 3/1971 Szumigala ..... F28F 13/187 29/558
3,963,012 A 6/1976 Harned
(Continued)

FOREIGN PATENT DOCUMENTS

JP 2001-165582 6/2001
JP 2008-070058 3/2008
JP 2015094490 A * 5/2015

*Primary Examiner* — Jianying C Atkisson
*Assistant Examiner* — For K Ling
(74) *Attorney, Agent, or Firm* — IPUSA, PLLC

(57) ABSTRACT

A heat pipe includes a first metal layer forming a liquid layer configured to move a working fluid that is liquefied from vapor, and a second metal layer forming a vapor layer configured to move the vapor of the working fluid that is vaporized. The first metal layer includes first cavities that cave in from a first surface of the first metal layer and are arranged apart from each other, second cavities that cave in from a second surface of the first metal layer opposite to the first surface of the first metal layer, first pores partially communicating with the first cavities and the second cavities, respectively, and second pores partially communicating side surfaces of the second cavities that are adjacent to each other. The second metal layer is provided on the first surface of the first metal layer and includes an opening exposing the plurality of first cavities.

14 Claims, 11 Drawing Sheets

(51) Int. Cl.
*F28F 3/08* (2006.01)
*F28F 3/04* (2006.01)
*F28D 21/00* (2006.01)

(52) U.S. Cl.
CPC ..... *F28D 15/04* (2013.01); *F28F 3/04* (2013.01); *F28F 3/08* (2013.01); *F28D 2021/0028* (2013.01)

(56) References Cited

U.S. PATENT DOCUMENTS 4,457,059 A * 7/1984 Alario ..... B21C 37/151 165/104.26
4,606,405 A * 8/1986 Nakayama ..... F28F 13/187 165/133
4,678,029 A * 7/1987 Sasaki ..... F28F 13/187 165/133
5,761,037 A 6/1998 Anderson et al.
6,330,907 B1 12/2001 Ogushi et al.
6,397,935 B1 6/2002 Yamamoto et al.
7,188,662 B2 3/2007 Brewer et al.
7,770,631 B2 * 8/2010 Wang ..... F28D 15/0233 165/104.26
7,992,625 B1 8/2011 Spokoiny et al.
2002/0020518 A1 * 2/2002 Li ..... F28D 15/0233 165/104.11
2007/0240857 A1 10/2007 Hou et al.
2009/0323285 A1 * 12/2009 Ryoson ..... H01L 23/427 361/700
2010/0294200 A1 * 11/2010 Zhang ..... F28D 15/046 118/728
2010/0326632 A1 12/2010 Nagai et al.
2011/0011565 A1 * 1/2011 Hou ..... F28D 15/06 165/104.26
2011/0048341 A1 * 3/2011 Zhang ..... F28D 15/046 122/366

* cited by examiner

HEAT PIPE

CROSS-REFERENCE TO RELATED APPLICATION

This application is a divisional application of U.S. patent application Ser. No. 15/807,797 filed on Nov. 9, 2017, which is based upon and claims priority to Japanese Patent Application No. 2016-242730, filed on Dec. 14, 2016, and No. 2017-112587 filed on Jun. 7, 2017, the entire contents of which are incorporated herein by reference.

FIELD

Certain aspects of the embodiments discussed herein are related to heat pipes.

BACKGROUND

A heat pipe is a known device for cooling a heat-generating component, such as a CPU (Central Processing Unit) or the like, that is provided in electronic devices. The heat pipe utilizes a phase change of a working fluid to transfer heat.

One example of the heat pipe includes plates that are mutually arranged at 90-degree crossing angles in a lattice, where each plate has a meander groove formed on one surface thereof. The working fluid is sealed in a tunnel of the meander groove. This heat pipe has a structure in which a vapor pipe and a liquid pipe are not separate, as proposed in Japanese Laid-Open Patent Publication No. 2001-165582, for example.

However, according to the proposed heat pipe described above, the working fluid that is condensed and returned and the vapor diffusion from an evaporation part pass through the same tunnel. For this reason, the working fluid evaporates in a vicinity of the evaporation part and spreads along the tunnel of the groove, but the vapor can be prevented from spreading due to the working fluid existing in the tunnel. In addition, when the working fluid that is cooled, condensed, and liquefied returns to the evaporation part after the vapor spreads, the liquefied working fluid collides with the vapor. Accordingly, heat dissipation of the proposed heat pipe is poor because the evaporation and the condensation do not occur cyclically.

SUMMARY

Accordingly, it is an object in one aspect of the embodiments to provide a heat pipe that can improve the heat dissipation, and a method of manufacturing such a heat pipe.

According to one aspect of the embodiments, a heat pipe includes a first metal layer forming a liquid layer configured to move a working fluid that is liquefied from vapor; and a second metal layer forming a vapor layer configured to move the vapor of the working fluid that is vaporized, wherein the first metal layer includes a plurality of first cavities that cave in from a first surface of the first metal layer and are arranged apart from each other, a plurality of second cavities that cave in from a second surface of the first metal layer opposite to the first surface of the first metal layer, a plurality of first pores partially communicating with the plurality of first cavities and the plurality of second cavities, respectively, and a plurality of second pores partially communicating side surfaces of the plurality of second cavities that are adjacent to each other, and wherein the second metal layer is provided on the first surface of the first metal layer and includes an opening exposing the plurality of first cavities.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

DESCRIPTION OF EMBODIMENTS

Figure 1A:
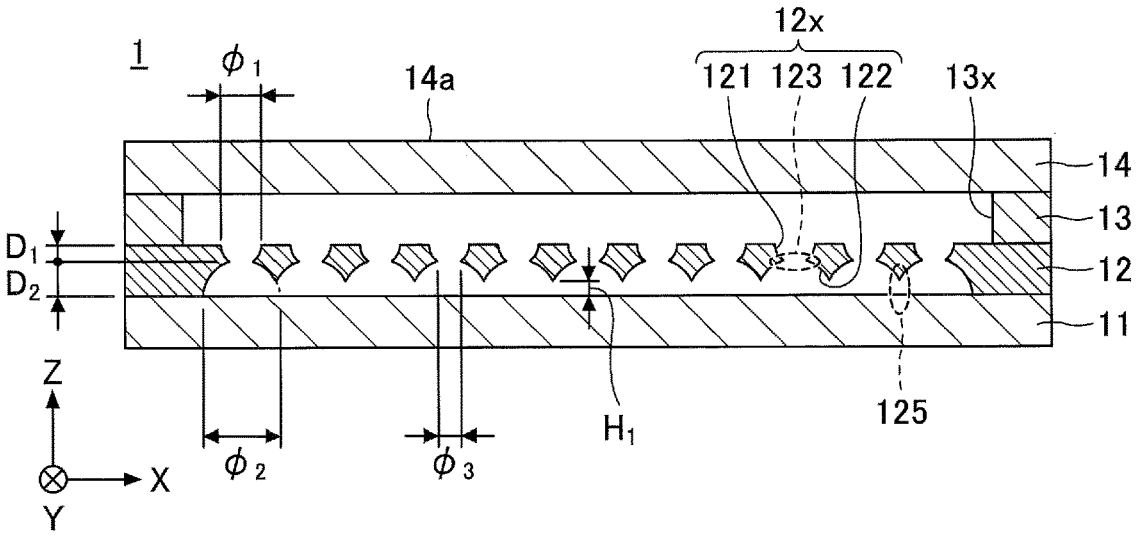
FIGS. 1A and 1B are diagrams illustrating an example of the heat pipe in a first embodiment.

Preferred embodiments of the present invention will be described with reference to the accompanying drawings. In the drawings, those parts that are the same are designated by the same reference numerals, and a repeated description of the same parts may be omitted.

A description will now be given of the heat pipe and the method of manufacturing the heat pipe in each embodiment according to the present invention.

First Embodiment

[Structure of Heat Pipe in First Embodiment]

Figure 1B:
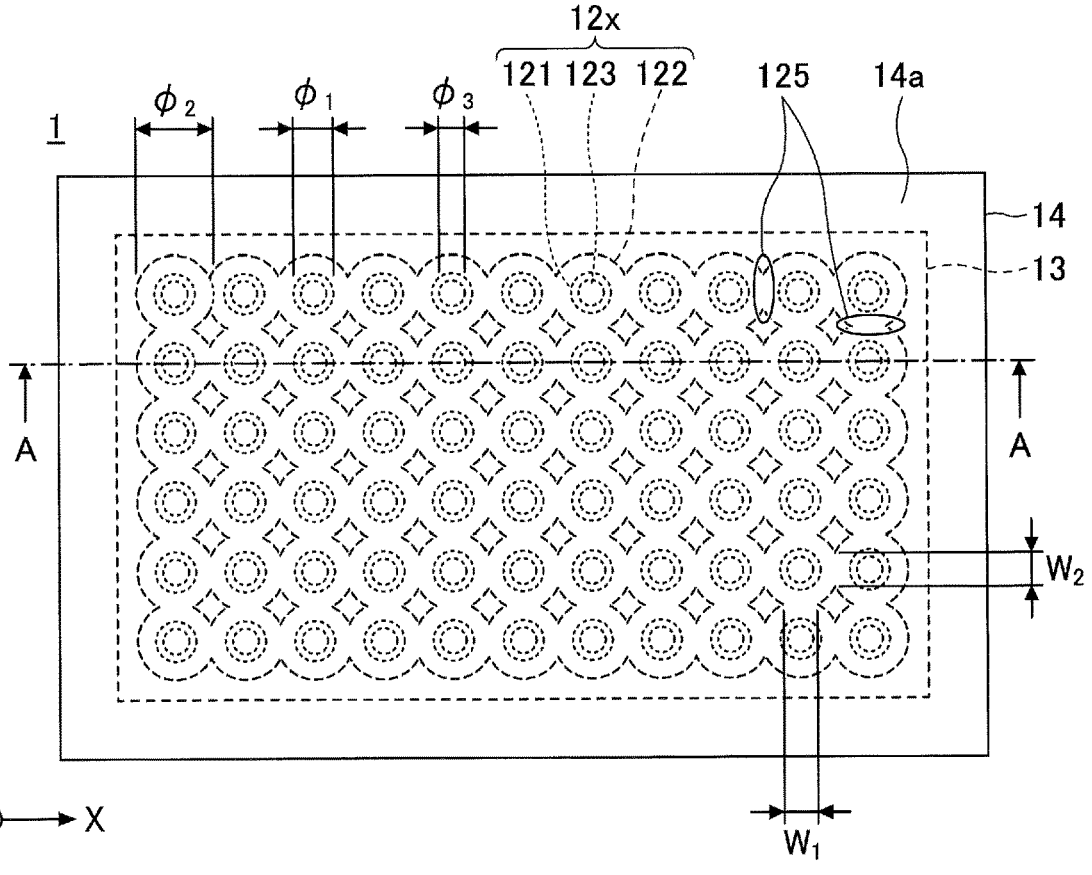

First, a description will be given of a structure of the heat pipe in a first embodiment. FIGS. 1A and 1B are diagrams illustrating an example of the heat pipe in the first embodiment. FIG. 1B illustrates a plan view of the heat pipe, and FIG. 1A illustrates a cross sectional view of the heat pipe along a line A-A in FIG. 1B.

As illustrated in FIGS. 1A and 1B, a heat pipe 1 is an omnidirectional heat pipe having a stacked structure including 4 metal layers 11 through 14. The metal layers 11 through 14 are made of copper having a sufficiently high thermal conductivity, for example, and are mutually bonded directly by solid-phase (or solid-state) welding. Each of the metal layers 11 through 14 may have a thickness in a range of approximately 50 μm to approximately 200 μm, for example. A material forming the metal layers 11 through 14 is not limited to copper, and the metal layers 11 through 14 may be made of any suitable material having the sufficiently high thermal conductivity, such as stainless steel, aluminum, magnesium alloys, or the like. In this example, a planar shape of the heat pipe 1, in a plan view viewed from above a top surface 14*a* of the metal layer 14 in FIG. 1A in a normal direction to the top surface 14*a*, is a rectangular shape.

In FIGS. 1A and 1B, a Z-direction denotes a stacking direction (or thickness direction) in which the metal layers 11 through 14 are stacked (or the thickness of the metal layers 11 through 14 is measured). An X-direction denotes a direction parallel to one side forming a geometrical shape of the top surface 14*a* of the metal layer, and a Y-direction denotes a direction perpendicular to the X-direction within the top surface 14*a* of the metal layer 14. Definitions of the X-direction, the Y-direction, and the Z-direction in FIGS. 1A and 1B are the same for similar figures described hereinafter. In addition, in this embodiment, it is assumed for the sake of convenience that a top side or one side of the heat pipe 1 refers to a side provided with the metal layer 14, and that a bottom side or the other side of the heat pipe 1 refers to a side provided with the metal layer 11. Further, it is also assumed for the sake of convenience that a top surface or one surface of each part refers to a surface facing towards the metal layer 14, and a bottom surface or the other surface of each part refers to a surface facing towards the metal layer 11.

In the heat pipe 1, the metal layer 14 and the metal layer 11, respectively forming outermost layers, are continuous metal layers having no holes or grooves.

The metal layer 12 is stacked on a top surface of the metal layer 11. The metal layer 12 includes a plurality of cavities 121 extending in the Z-direction from the side of the metal layer 13 (the top surface of the metal layer 12), and a plurality of cavities 122 extending in the Z-direction from the side of the metal layer 11 (the bottom surface of the metal layer 12). Each cavity 121 caves in from the top surface of the metal layer 12 towards an approximate center part of the metal layer 12 along the Z-direction, and each cavity 122 caves in from the bottom surface of the metal layer 12 towards an approximate center part of the metal layer 12 along the Z-direction. In addition, the cavity 121 and the cavity 122, that correspond to each other, partially communicate to a pore 123.

The metal layer 12 includes a plurality of through-holes 12*x* that penetrate in the Z-direction. Each through-hole 12*x* is formed by the corresponding cavities 121 and 122 and the pore 123.

The plurality of cavities 121 are arranged in a matrix arrangement. For example, the plurality of cavities 121 includes rows of cavities arranged at predetermined intervals in the X-direction, and columns of cavities arranged at predetermined intervals in the Y-direction. However, the rows of the cavities do not necessarily have to be arranged in the X-direction, and the columns of the cavities do not necessarily have to be arranged in the Y-direction.

In addition, the rows and the columns of the cavities do not necessarily have to be perpendicular to each other. For example, the columns of the cavities may be arranged obliquely to the rows of the cavities, and an entire planar shape of a region in which the plurality of cavities 121 are arranged may be a parallelogram shape. Further, the number of cavities 121 included each row and the number of cavities 121 included in each column may be the same, or may be different. For example, in a case in which the number of cavities 121 included each row and the number of cavities 121 included in each column are different, the entire planar shape of the region in which the plurality of cavities 121 are arranged may be a trapezoidal shape. Moreover, the plurality of cavities 121 may be arranged in a staggered pattern.

One cavity 122 is provided in correspondence with each cavity 121. The corresponding cavities 121 and 122 are arranged to overlap in the plan view, and bottom surfaces of the corresponding cavities 121 and 122 partially communicate with each other to form the pore 123. In other words, the plurality of cavities 122 are arranged in a matrix arrangement, in correspondence with the plurality of cavities 121, and the bottom surfaces of the cavities 121 and 122 that overlap in the plan view connect with each other and communicate in the Z-direction. The cavities 121 and 122 do not need to be arranged to perfectly overlap each other in the plan view, as long as the bottom surfaces of the cavities 121 and 122 are arranged to communicate with each other through the pore 123.

The cavities 121 are arranged apart from each other. In other words, the cavities 121 that are adjacent to each other in the X-direction and the Y-direction do not communicate with each other. On the other hand, side surfaces defining the cavities 122 that are adjacent to each other in the X-direction and the Y-direction partially communicate with each other in the X-direction and the Y-direction through corresponding pores 125. In other words, all of the cavities 122 that are arranged in the matrix arrangement communicate through the pores 125.

An area of a part of each of the plurality of cavities 121 opening at the top surface of the metal layer 12 is smaller than an area of a part of each of the plurality of cavities 122 opening at the bottom surface of the metal layer 12. Each cavity 121 is formed in an approximate hemispherical shape, and the planar shape of the cavity 121 is a circular shape. In this case, a diameter $Ø_1$ of the part of the cavity 121 opening on the side of the metal layer 13 may be approximately 25 μm, for example.

Each cavity 122 is formed to an approximate hemispherical shape, and the planar shape of the cavity 122 is a circular shape. In this case, a diameter $Ø_2$ of the part of the cavity 122 opening at the bottom surface of the metal layer 12 is greater than the diameter $Ø_1$ of the part of the cavity 121 opening at the top surface of the metal layer 12, and may be approximately 50 μm, for example.

A position where the corresponding cavities 121 and 122 communicate with each other (that is, a position of the pore 123) is located closer to the top surface of the metal layer 12 than a center along the thickness direction of the metal layer 12, and a ratio $D_1$:$D_2$ in FIG. 1A may be approximately 3:7, for example. A diameter $Ø_3$ of the pore 123 is smaller than the diameter $Ø_1$ of the cavity 121 and the diameter $Ø_2$ of the cavity 122, and may be approximately 15 μm, for example.

The planar shape of each of the cavities 121 and 122 is not limited to the circular shape, and may be an arbitrary shape, such as an oval shape, a polygonal shape, or the like. In addition, the cavity 121 is not limited to the approximate hemispherical shape, and may have an arbitrary tapered shape defined by inner walls that widen from the pore 123 towards the top surface of the metal layer 12. Similarly, the cavity 122 is not limited to the approximate hemispherical shape, and may have an arbitrary tapered shape defined by inner walls that widen from the pore 123 towards the bottom surface of the metal layer 12.

A width $W_1$ of the horizontally oriented pores 125 along the X-direction, a width $W_2$ of the vertically oriented pores 125 along the Y-direction, and a height $H_1$ of the horizontally and vertically oriented pores 125 along the Z-direction respectively are smaller than the diameter $Ø_2$ of the cavity 122. The width $W_1$ of the horizontally oriented pores 125 along the X-direction may be approximately 20 μm, for example. The width $W_2$ of the vertically oriented pores 125 along the Y-direction may be approximately 20 μm, for example. The height $H_1$ of the horizontally and vertically oriented pores 125 along the Z-direction may be approximately 10 μm, for example.

The metal layer 13 is stacked on the top surface of the metal layer 12. The metal layer 13 is frame-shaped, and includes an opening 13*x* that exposes the plurality of through-holes 12*x* arranged in the matrix arrangement. The metal layer 14 is stacked on the metal layer 13, to form a lid on the frame-shaped metal layer 13.

Figure 2:
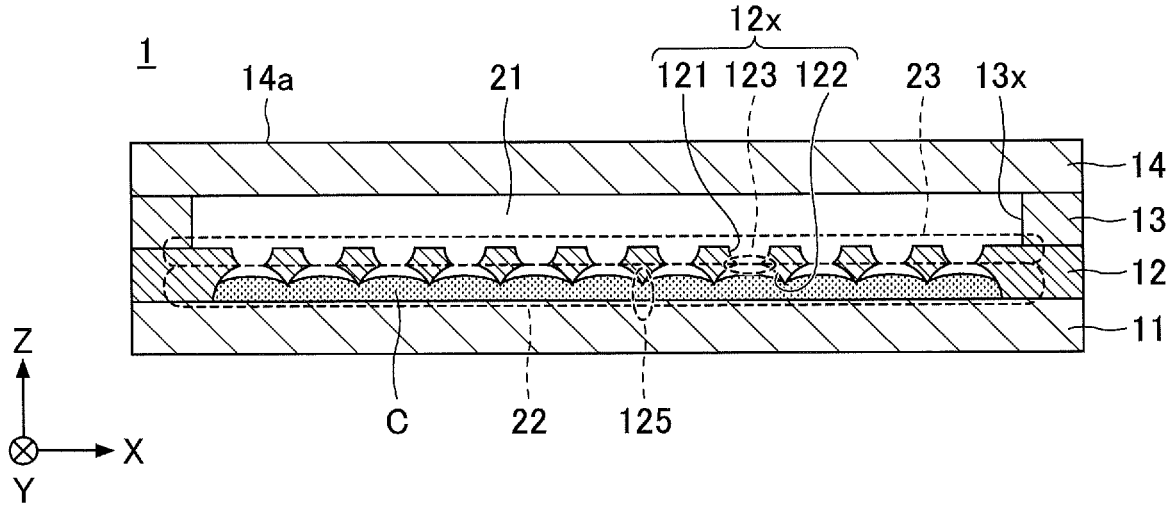
FIG. 2 is a diagram for explaining functions of parts of the heat pipe in the first embodiment.

FIG. 2 is a diagram for explaining functions of parts of the heat pipe in the first embodiment, and illustrates a cross section corresponding to that of FIG. 1A.

As illustrated in FIG. 2, the metal layer 11 and the metal layer 14 form outer walls of the heat pipe 1. In addition, the frame-shaped metal layer 13 forms a vapor layer of the heat pipe 1. More particularly, the metal layer (or vapor layer) 13 includes a vapor-phase part 21 that is surrounded by the top surface of the metal layer 12 and the bottom surface of the metal layer 14, within the opening 13*x* of the metal layer 13. The vapor-phase part 21 forms a region in which vapor $C_v$, obtained by vaporizing a working fluid C, is moved (or transferred) from a high-temperature end to a low-temperature end.

The metal layer 12 forms a liquid layer of the heat pipe 1. More particularly, the metal layer (or liquid layer) 12 includes a liquid passage part 22 and a vent part 23. The liquid passage part 22 is formed by the cavities 122 communicating in the X-direction and the Y-direction at the metal layer 12. The liquid passage part 22 (or the cavities 122) forms a region in which the working fluid C, liquefied at the low-temperature end, is moved to the high-temperature end.

The vent part 23 is famed by each of the cavities 121 communicating to the cavities 122, and the pores 123, at the metal layer 12. The vent part 23 partitions the vapor-phase part 21 with respect to the liquid passage part 22, and forms a region in which the working fluid C generated by the vapor-phase part 21 is moved to the liquid passage part 22.

In an initial state in which the heat pipe 1 is not in contact with heat-generating components, the liquid passage part 22 is filled by the working fluid C. The working fluid C is not limited to a particular kind of fluid. From a viewpoint of efficiently cooling the heat-generating components by evaporative latent heat, it is preferable to use, as the working fluid C, a fluid having a high vapor pressure and a high evaporative latent heat. Examples of such a fluid having the high vapor pressure and the high evaporative latent heat include ammonia, water, freon, alcohol, acetone, or the like, for example.

Figure 3A:
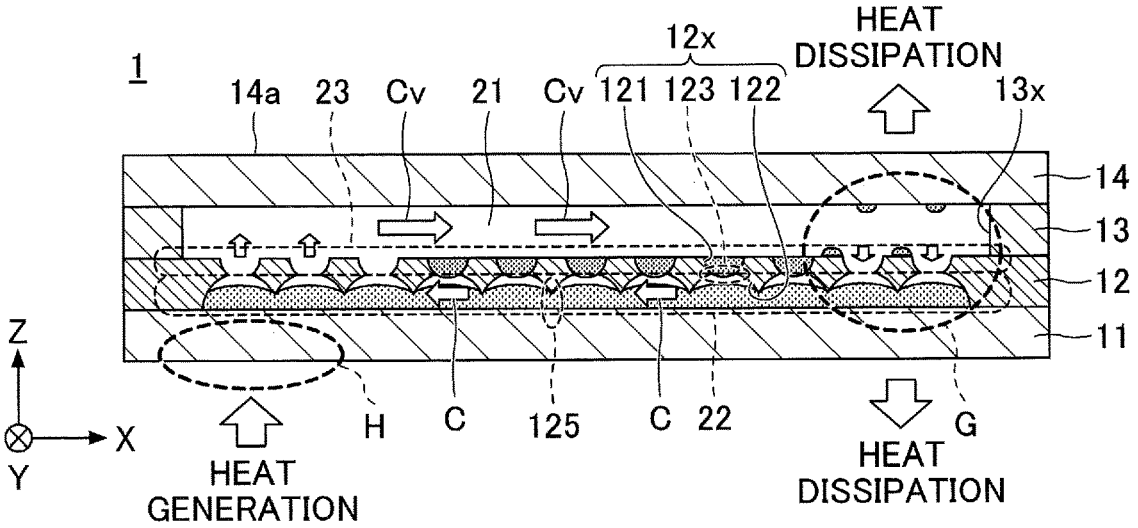
FIGS. 3A and 3B are diagrams for explaining the functions of the parts of the heat pipe in the first embodiment.
Figure 3B:
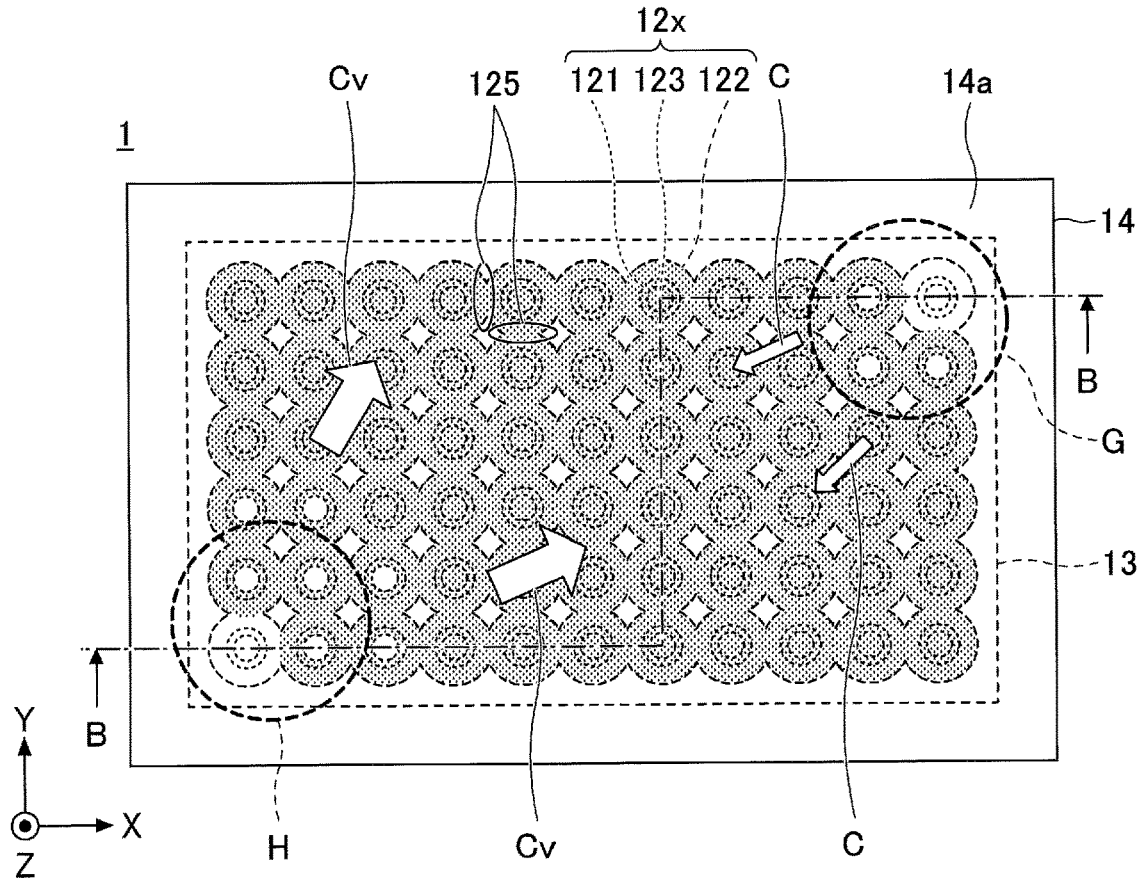

FIGS. 3A and 3B are diagrams for explaining the functions of the parts of the heat pipe in the first embodiment. FIG. 3B illustrates a plan view of the heat pipe, and FIG. 3A illustrates a cross sectional view along a line B-B in FIG. 3B.

As illustrated in FIGS. 3A and 3B, the through-holes 12*x* (the cavities 121 and 122, and the pores 123) of the heat pipe 1 are uniformly arranged in the plan view viewed from above the top surface 14*a* of the metal layer 14 in FIG. 3A in the normal direction to the top surface 14*a*. For this reason, it is possible to arrange the heat-generating components, such as semiconductor devices or the like, at arbitrary positions on the outer wall formed by the metal layer 11. A position where the heat-generating component is arranged, becomes a heat-generating part. In the example illustrated in FIG. 3A, a heat-generating part (or evaporation part) H is located at the bottom left of the metal layer 11, as encircled by dotted lines.

In FIGS. 3A and 3B, when a temperature of the metal layers 11 and 12 in a vicinity of the heat-generating part H rises due to heat generation, the working fluid C within the liquid passage part 22 in the vicinity of the heat-generating part H vaporizes (or evaporates) to generate the vapor $C_v$. The generated vapor $C_v$ moves to the vapor-phase part 21 through the vent part 23 as indicted by arrows, to spread within the entire vapor-phase part 21. A condensation part G is located at a position separated from the heat-generating part H, as encircled by dotted lines. The vapor $C_v$ is liquefied at the condensation part G due to heat dissipation.

Accordingly, the heat generated from the heat-generating part H moves to the condensation part G and is dissipated from the condensation part G. The working fluid C that is liquefied at the condensation part G is attracted into the liquid passage part 22 through the vent part 23 due to capillary attraction of the pores 123. The working fluid C attracted into the liquid passage part 22 passes through the liquid passage part 22 due to capillary attraction of the pores 125, to move to a location lacking the working fluid C, that is, to the heat-generating part H. Thereafter, the evaporation and the condensation are cyclically repeated in a similar manner, to control and limit the temperature rise of the heat-generating part H.

[Method of Manufacturing Heat Pipe in First Embodiment]

Next, a description will be given of the method of manufacturing the heat pipe in the first embodiment. FIGS. 4A, 4B, 4C, and 4D are diagrams for explaining examples of manufacturing processes of the heat pipe in the first embodiment, and respectively illustrate cross sectional views corresponding to the cross sectional view of FIG. 1A.

Figure 4A:
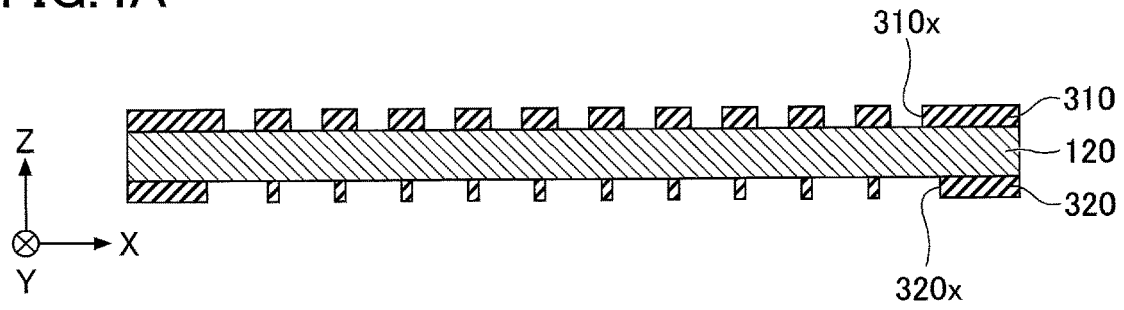
FIGS. 4A, 4B, 4C, and 4D are diagrams for explaining examples of manufacturing processes of the heat pipe in the first embodiment.

First, in the process illustrated in FIG. 4A, a metal sheet 120 is prepared, a resist layer 310 having openings 310*x* is formed on a top surface of the metal sheet 120, and a resist layer 320 having openings 320*x* is formed on a bottom surface of the metal sheet 120. The openings 310*x* are formed to expose the top surface of the metal sheet 120 at positions corresponding to the cavities 121 illustrated in FIG. 1B. In addition, the openings 320*x* are formed to expose the bottom surface of the metal sheet 120 at positions corresponding to the cavities 122 illustrated in FIG. 1B.

The metal sheet 120 is a member that finally becomes the metal layer 12, and may be made of a material such as copper, stainless steel, aluminum, magnesium alloys, or the like, for example. The metal sheet 120 may have a thickness in a range of approximately 50 μm to approximately 200 μm, for example. The resist layers 310 and 320 may be made of a photosensitive dry film resist or the like, for example. The openings 310*x* and 320*x* may be formed by exposing and developing the resist layers 310 and 320.

Figure 4B:
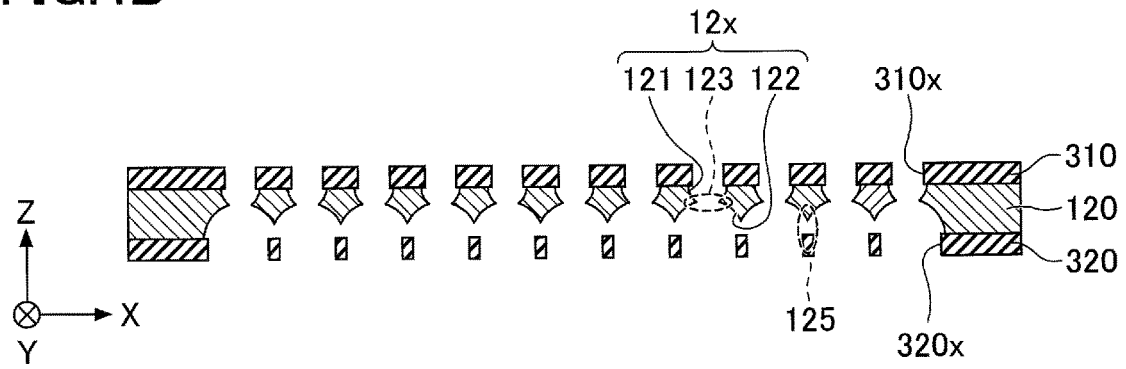

Next, in the process illustrated in FIG. 4B, the metal sheet 120 exposed within the openings 310*x* is subjected to half-etching from the top surface of the metal sheet 120, and the metal sheet exposed within the openings 320*x* is subjected to half-etching from the bottom surface of the metal sheet 120. As a result, the cavities 121 are formed at the top surface of the metal sheet 120, and the cavities 122 are formed at the bottom surface of the metal sheet 120. In addition, the pores 123 are formed by partially communicating the bottom surfaces of the corresponding cavities 121 and 122 in the Z-direction, to form the through-holes 12*x* by the cavities 121 and 122 and the pores 123. The pores 125 are formed by partially communicating the side surfaces of the cavities 122 that are adjacent to each other in the X-direction and the Y-direction. The half-etching of the metal sheet 120 may use an etchant such as a ferric chloride solution, for example. Thereafter, the resist layers 310 and 320 are stripped (or removed) by a stripping liquid (or remover), to complete the metal layer 12 in which the through-holes 12*x* are arranged in the matrix arrangement.

Figure 4C:
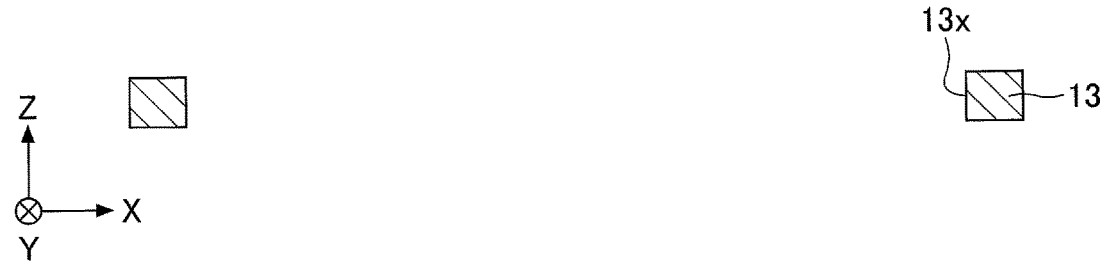

Next, in the process illustrated in FIG. 4C, the frame-shaped metal layer 13, having the opening 13*x*, is formed. More particularly, a metal sheet may be prepared, and an unwanted part of the metal sheet may be removed by etching, to form the metal layer 13. Alternatively, the metal sheet may be prepared, and the unwanted part of the metal sheet may be removed by pressing or laser machining, to form the metal layer 13.

Figure 4D:
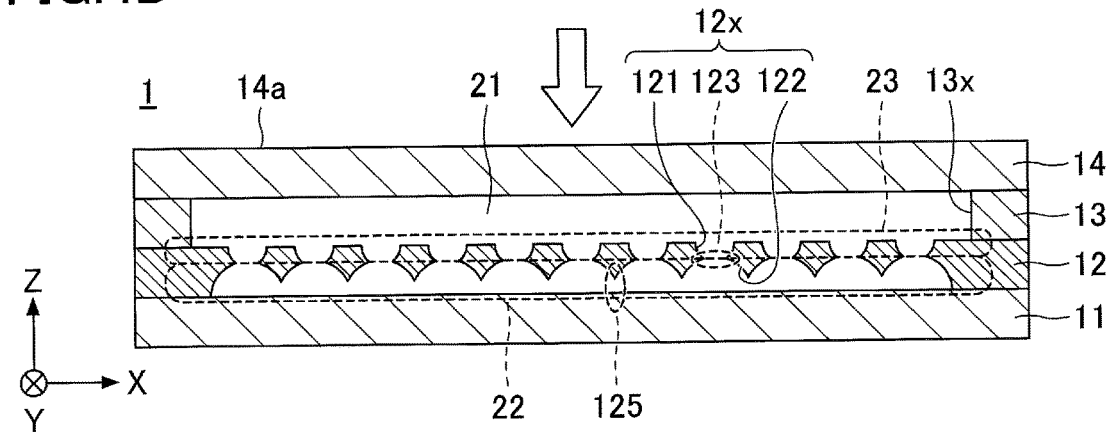

Next, in the process illustrated in FIG. 4D, the metal layer 11 and the metal layer 14, which are continuous metal layers having no holes or grooves, are prepared. Then, the metal layers 11, 12, 13, and 14 are successively stacked, pressed, and heated, to be bonded by solid-phase (or solid-state) welding. Hence, the mutually adjacent metal layers are directly bonded to each other, to thereby complete the heat pipe 1 having the vapor-phase part 21, the liquid passage part 22, and the vent part 23. Thereafter, a vacuum pump or the like is used to exhaust or purge the inside of the liquid passage part 22, the working fluid C is injected into the liquid passage part 22 from an injection port (not illustrated), and the injection port is sealed.

The solid-phase (or solid-state) welding refers to a method of bonding two welding targets together in the solid-phase (or solid-state), without melting the two welding targets, by heating, softening, and pressing the welding targets to cause plastic deformation. Preferably, the metal layers 11 through 14 are all made of the same material, so that the mutually adjacent metal layers can be satisfactorily bonded by the solid-phase (or solid-state) welding.

In the heat pipe 1 described above, the vapor-phase part 21 through which the vapor flows, and the liquid passage part 22 through which the working fluid C flows, are provided separately. For this reason, diffusion of the vapor $C_v$ from the heat-generating part (or evaporation part) H, and return of the working fluid C condensed at the condensation part G, occur in different layers and do not collide with each other, to prevent mutual interference. As a result, the evaporation and the condensation are cyclically repeated, to improve the heat dissipation.

In addition, the through-holes 12*x* (the cavities 121 and 122, and the pores 123) of the heat pipe 1 are uniformly arranged in the plan view viewed from above the top surface 14*a* of the metal layer 14 in the normal direction to the top surface 14*a*. For this reason, there is no distinction between the heat-generating part (or evaporation part) H and the condensation part G. In other words, the heat-generating part H and the condensation part G can be arranged at random, and it is possible to arrange the heat-generating components, such as the semiconductor devices or the like, at arbitrary positions on the outer wall formed by the metal layer 11, such that the position where the heat-generating component is arranged becomes the heat-generating part H. Further, the vapor $C_v$ evaporated in the vicinity of the heat-generating part H spreads in all directions, and a low-temperature part becomes the condensation part G that condenses the vapor. According to such a configuration, it is possible to provide a heat pipe that exhibits a uniform thermal diffusion performance in all directions and is not dependent on orientation of the heat pipe.

In addition, according to the heat pipe 1, the liquid passage part 22 and the vent 23 are formed in a single metal layer. For this reason, it is possible to reduce the thickness of the heat pipe 1 and provide a thin heat pipe.

First Modification of First Embodiment

In a first modification of the first embodiment, an example of the heat pipe is provided with pillars (or supports). In this first modification of the first embodiment, a repeated description of those parts that are the same as those of the first embodiment may be omitted.

Figure 5A:
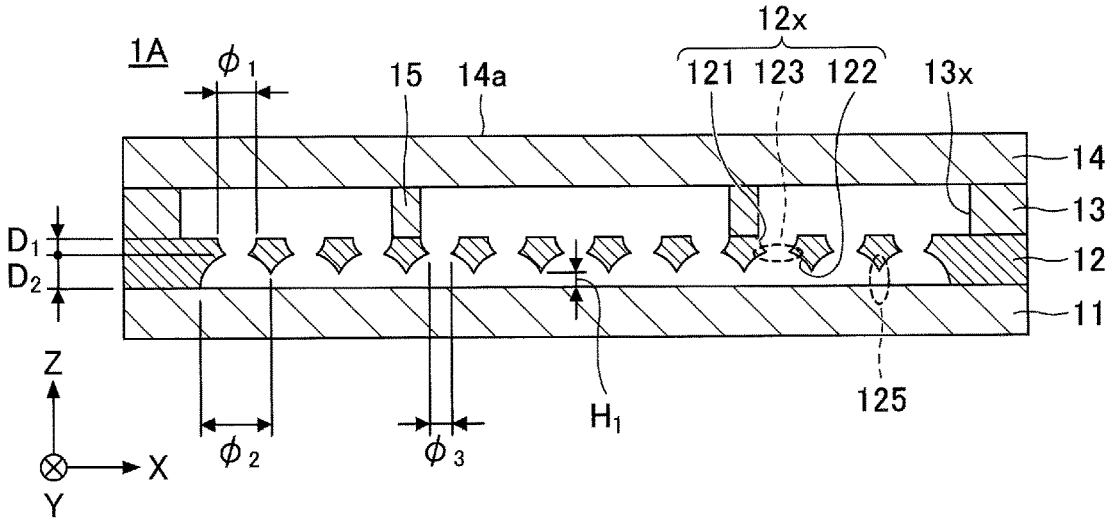
FIGS. 5A and 5B are diagrams illustrating an example of the heat pipe in a first modification of the first embodiment.
Figure 5B:
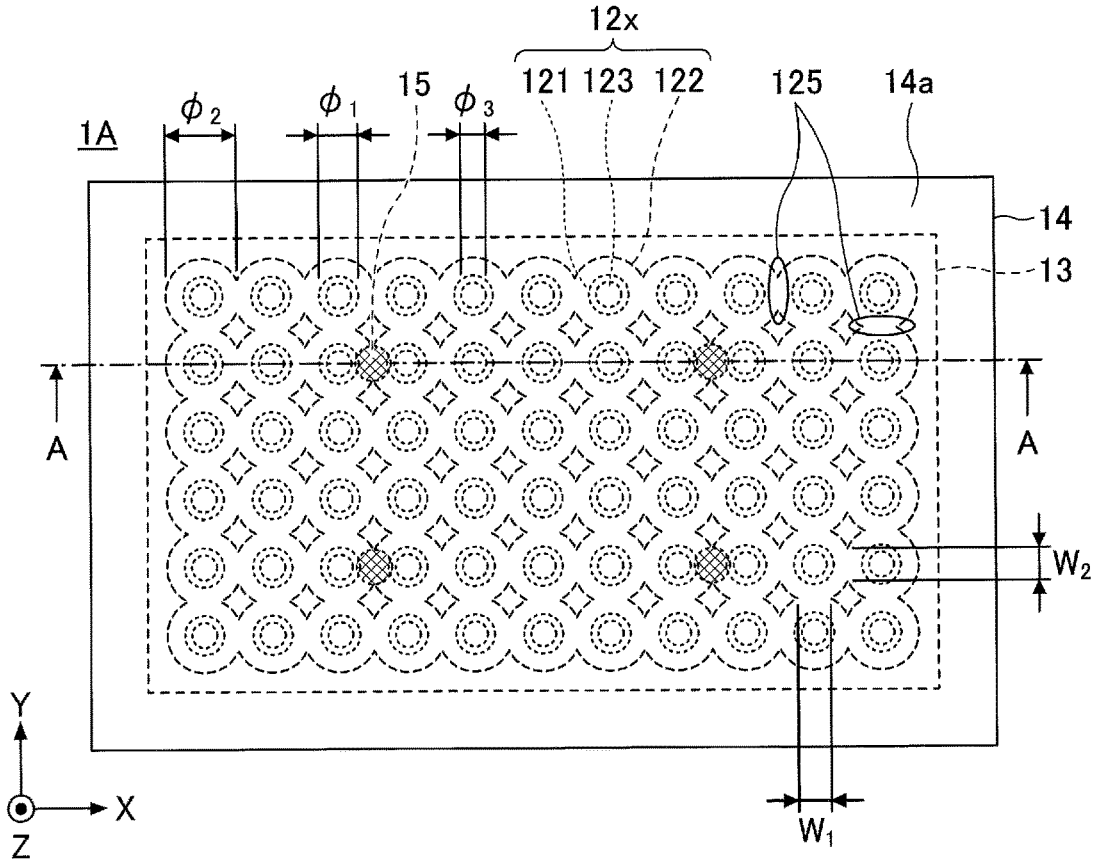

FIGS. 5A and 5B are diagrams illustrating the example of the heat pipe in the first modification of the first embodiment. FIG. 5B illustrates a plan view of the heat pipe, and FIG. 5A illustrates a cross sectional view of the heat pipe along a line A-A in FIG. 5B.

As illustrated in FIGS. 5A and 5B, a heat pipe 1A includes pillars (or supports) 15 that are provided on the inner side of the frame-shaped metal layer 13. In the example illustrated in FIGS. 5A and 5B, 4 pillars 15 are provided, however, it is possible to provide 1 to 3 pillars 15, or to provide 5 or more pillars 15.

By providing the pillars 15 on the inner side of the frame-shaped metal layer 13, it is possible to prevent the metal layer 14 from collapsing during the manufacture of the heat pipe 1A at the process illustrated in FIG. 4D when the metal layers 11, 12, 13, and 14 are successively stacked and pressed. In addition, it is possible to prevent the vapor-phase part 21 from collapsing due to deformation of the metal layer 14 while the heat pipe 1A operates.

Second Modification of First Embodiment

In a second modification of the first embodiment, an example of the heat pipe is provided with a plurality of cavities at the top surface of the metal layer 12 with respect to a single cavity 122. In this second modification of the first embodiment, a repeated description of those parts that are the same as those of the first embodiment may be omitted.

Figure 6A:
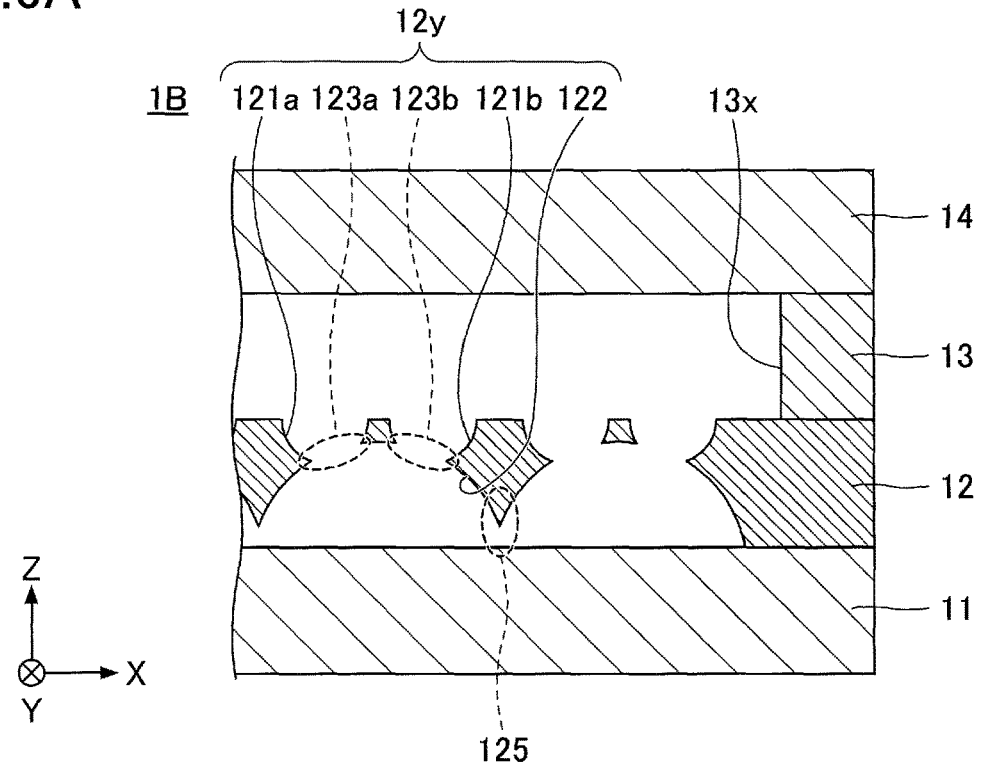
FIGS. 6A and 6B are diagrams illustrating an example of the heat pipe in a second modification of the first embodiment.
Figure 6B:
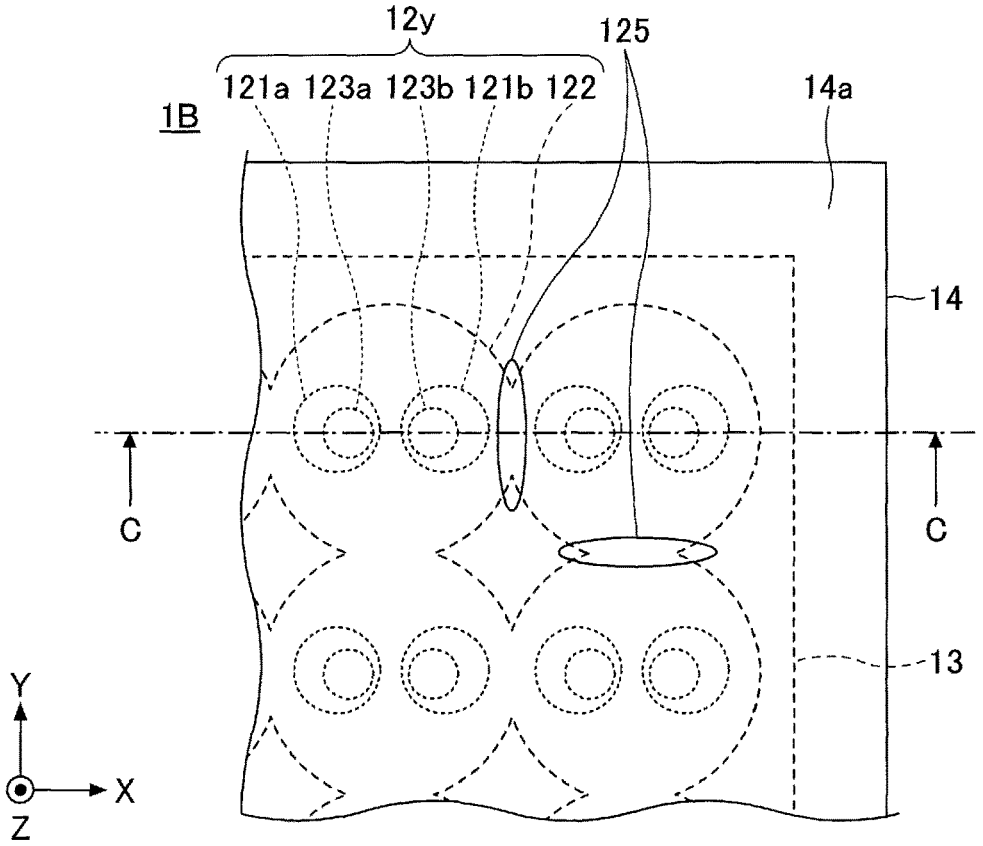

FIGS. 6A and 6B are diagrams illustrating the example of the heat pipe in the second modification of the first embodiment. FIG. 6B illustrates a partial plan view of the heat pipe, and FIG. 6A illustrates a partial cross sectional view of the heat pipe along a line C-C in FIG. 6B.

In a heat pipe 1B illustrated in FIGS. 6A and 6B, each of cavities 121*a* and 121*b* caves in from the top surface of the metal layer 12 towards the approximate center part of the metal layer 12 along the Z-direction, and each cavity 122 caves in from the bottom surface of the metal layer 12 towards an approximate center part of the metal layer 12 along the Z-direction. In addition, the cavities 121*a* and 121*b* and the cavity 122, that correspond to each other, partially communicate with each other to form pores 123*a* and 123*b*.

The metal layer 12 includes through-holes 12*y* that penetrate the metal layer 12 in the Z-direction. Each through-hole 12*y* is formed by the cavities 121*a* and 121*b*, the cavity 122, and the pores 123*a* and 123*b*, that correspond to each other.

In other words, in each through-hole 12*y*, the cavities 121*a* and 121*b* are provided with respect to one cavity 122. The cavities 121*a* and 121*b* and the cavity 122, that correspond to each other, are arranged to overlap each other in the plan view. Bottom surfaces of the cavities 121*a* and 122, that correspond to each other, partially communicate with each other to form the pore 123*a*. In addition, bottom surfaces of the cavity 121*b* and 122, that correspond to each other, partially communicate with each other to form the pore 123*b*.

The cavity 121*a* and the cavity 121*b*, that are adjacent to each other in the X-direction, are arranged apart from each other. Further, the cavities 121*a* that are adjacent to each other in the Y-direction, and the cavities 121*b* that are adjacent to each other in the Y-direction, are arranged apart from each other.

Areas of the cavities 121*a* and 121*b* opening at the top surface of the metal layer 12 are smaller than an area of the cavity 122 opening at the bottom surface of the metal layer 12. The cavities 121*a* and 121*b* are formed to an approximately hemispherical shape, and have a planar shape that is a circular shape, for example. Positions where the corresponding cavities 121*a* and 121*b* and the cavity 122 communicate with each other (that is, positions of the pores 123*a* and 123*b*) are located closer to the top surface of the metal layer 12 than the center along the thickness direction of the metal layer 12.

The planar shape of the cavities 121*a* and 121*b* is not limited to the circular shape, and may be an arbitrary shape, such as an oval shape, a polygonal shape, or the like. In addition, the cavities 121*a* and 121*b* are not limited to the approximate hemispherical shape, and may have an arbitrary tapered shape defined by inner walls that widen from the pores 123*a* and 123*b* towards the top surface of the metal layer 12.

Accordingly, in each through-hole 12*y*, 2 cavities 121*a* and 121*b* may be provided with respect to one cavity 122 at the top surface of the metal layer 12. In this case, the size of the pores 123*a* and 123*b* can be made smaller than the size of the pore 123 of the first embodiment, to thereby increase the capillary attraction when the working fluid C is attracted into the liquid passage part 22 from the vapor-phase part 21.

Of course, 3 or more cavities 121 may be provided with respect to one cavity 122. In addition, the plurality of cavities 121 provided with respect to one cavity 122 at the top surface of the metal layer 12 may have different sizes (for example, different diameters).

Third Modification of First Embodiment

In a third modification of the first embodiment, a density (or denseness) of the cavities is varied. In this third modification of the first embodiment, a repeated description of those parts that are the same as those of the first embodiment may be omitted.

Figure 7:
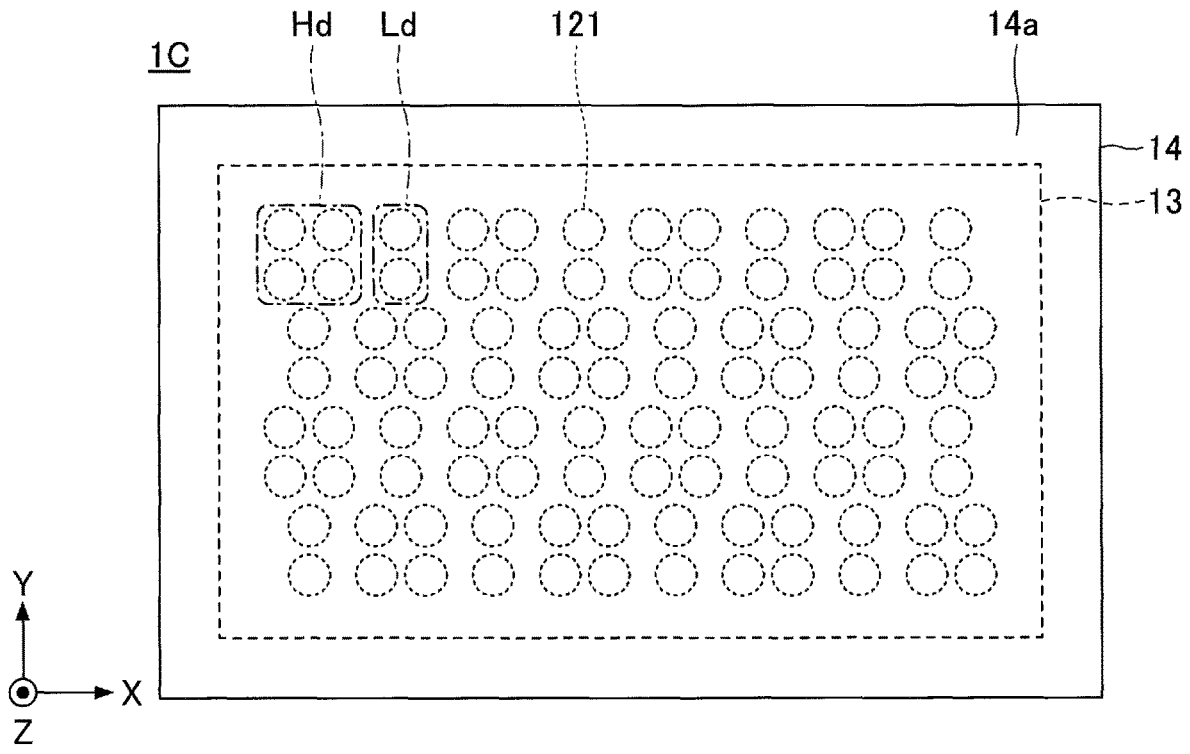
FIG. 7 is a diagram illustrating an example of the heat pipe in a third modification of the first embodiment.

FIG. 7 is a diagram illustrating an example of the heat pipe in the third modification of the first embodiment, and is a plan view corresponding to FIG. 1B. However, FIG. 7 only illustrates the cavities 121 provided at the top surface of the metal layer 12 with respect to the cavities 122 of the metal layer 12, and the illustration of the cavities 122 and the pores is omitted.

In a heat pipe 1C illustrated in FIG. 7, a high-density region $H_d$ and a low-density region $L_d$ are alternately arranged in the X-direction and the Y-direction. The cavities 121 are arranged at a high density in the high-density region $H_d$, while the cavities 121 are arranged at a low density in the low-density region $L_d$. In the high-density region $H_d$, a plurality of cavities 121 may be provided with respect to one cavity 122.

The density of the cavities 121 does not necessarily have to be uniform, and the high-density regions $H_d$ and the low-density regions $L_d$ may be provided as in the case of the heat pipe 1C. In this case, it is possible to expect effects of improving a thermal diffusion efficiency from the heat-generating parts. In addition, it is also possible to expect effects of improving a vaporization efficiency of the working fluid, and improving an efficiency of returning the liquefied working fluid to the liquid layer.

A number of region types having mutually different densities of the cavities 121 is not limited to 2 region types, and it is of course possible to provide 3 or more region types in which the densities of the cavities 121 are mutually different.

Fourth Modification of First Embodiment

In a fourth modification of the first embodiment, the size of the cavities is varied. In this fourth modification of the first embodiment, a repeated description of those parts that are the same as those of the first embodiment may be omitted.

Figure 8:
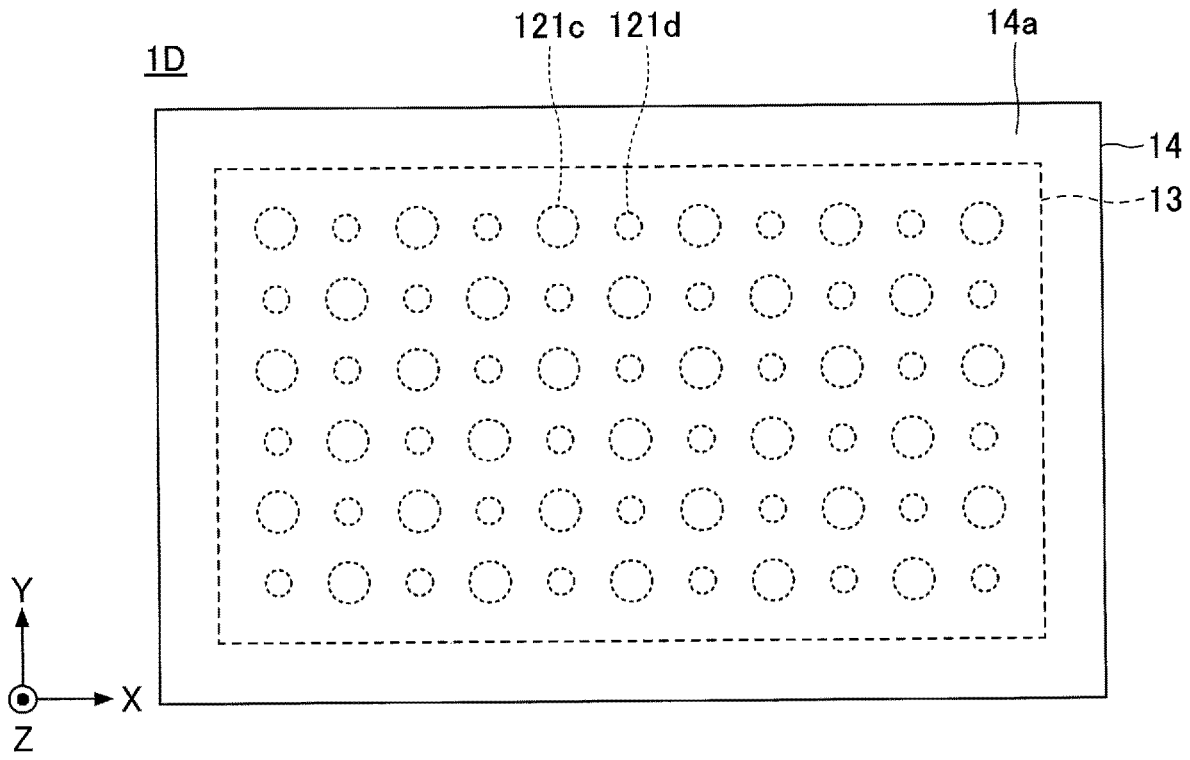
FIG. 8 is a diagram illustrating an example of the heat pipe in a fourth modification of the first embodiment.

FIG. 8 is a diagram illustrating an example of the heat pipe in the fourth modification of the first embodiment, and is a plan view corresponding to FIG. 1A. However, FIG. 8 only illustrates cavities 121*c* and 121*d* opening on the side of the metal layer 13 with respect to the cavities 122 of the metal layer 12, and the illustration of the cavities 122 and the pores 123 is omitted.

In a heat pipe 1D illustrated in FIG. 8, an area of the cavities 121*c* opening at the top surface of the metal layer 12 is large (for example, the diameter is large), while an area of the cavities 121*d* opening at the top surface of the metal layer 12 is small (for example, the diameter is small). The cavity 121*c* and the cavity 121*d* are alternately arranged in the X-direction and the Y-direction. The area of the cavities 121*c* is larger than the area of the cavities 121*d*. In other words, the area of the cavities 121*d* is smaller than the area of the cavities 121*c*. Similarly to the cavities 121 described above, the cavities 121*c* and 121*d* may be formed to an approximate spherical shape or the like, for example.

The areas of the cavities opening at the top surface of the metal layer 12 do not necessarily have to be the same, and the cavities 121*c* opening with the large area and the cavities 121*d* opening with the small area may be provided as in the case of the heat pipe 1D. In this case, it is possible to expect the effects of improving the vaporization efficiency of the working fluid, and improving the efficiency of returning the liquefied working fluid to the liquid layer.

A number of area types of the cavities opening on the side of the metal layer 12 is not limited to 2 area types having mutually different areas. The number of area types of the cavities opening on the side of the metal layer 12 may be 3 area types or more.

Second Embodiment

In a second embodiment, an example of the heat pipe is made even thinner. In this second embodiment, a repeated description of those parts that are the same as those of the first embodiment may be omitted.

[Structure of Heat Pipe in Second Embodiment]

Figure 9A:
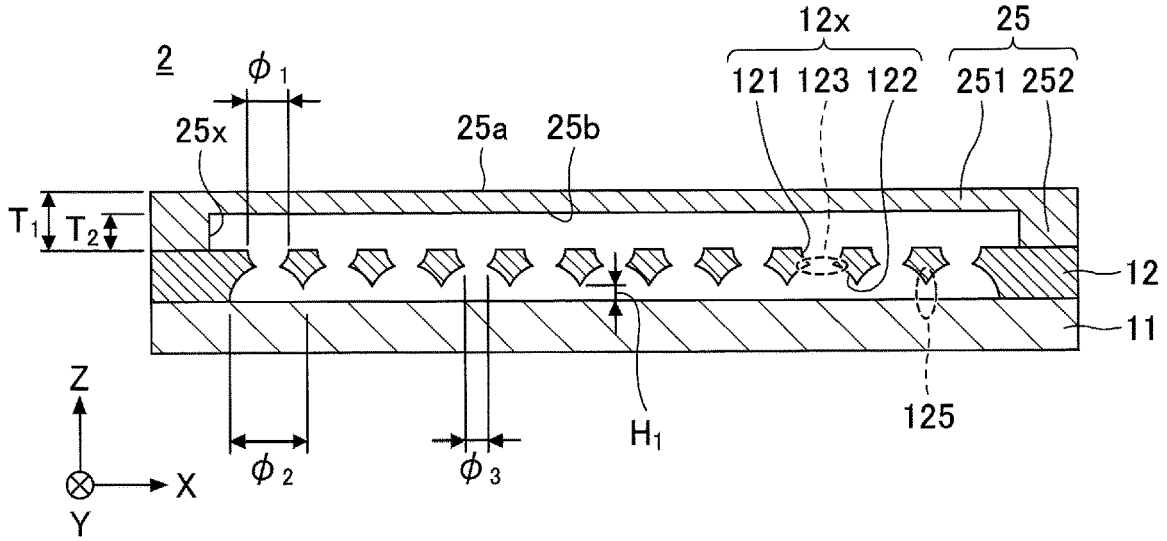
FIGS. 9A and 9B are diagrams illustrating an example of the heat pipe in a second embodiment.
Figure 9B:
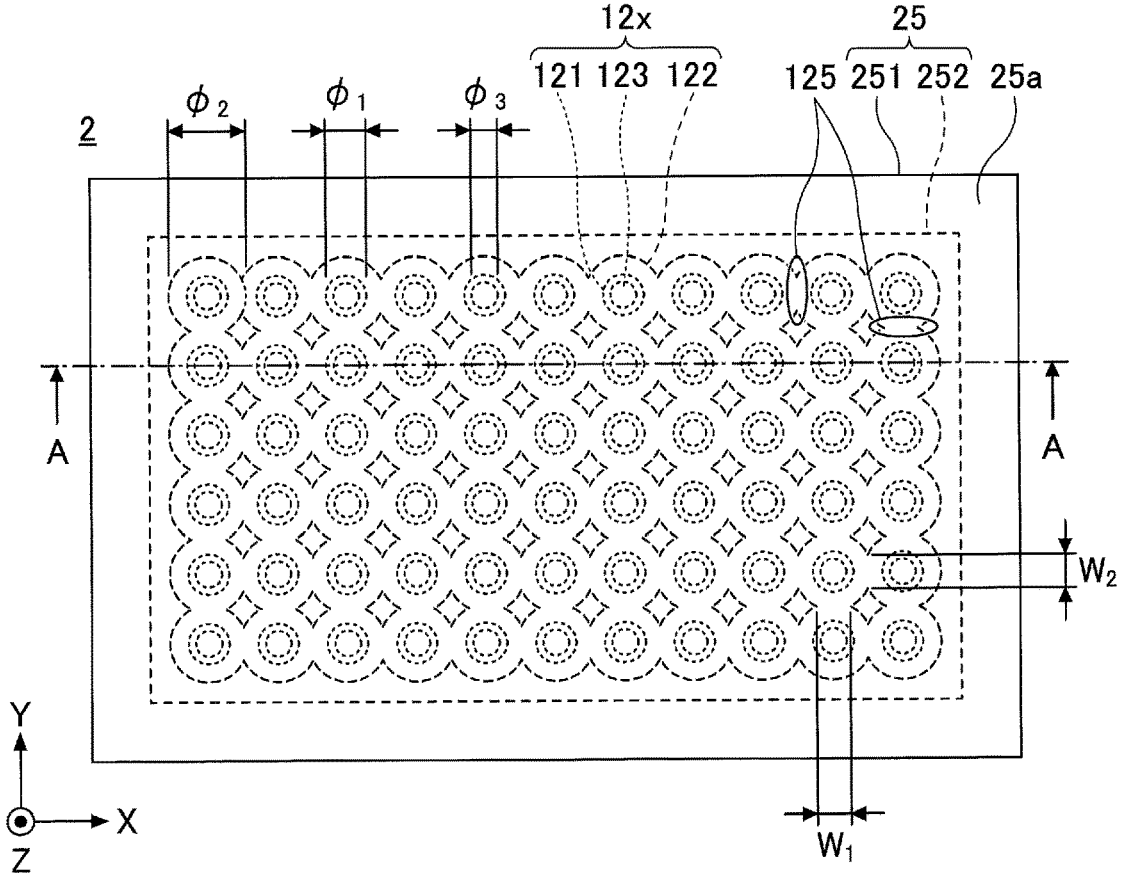

First, a description will be given of a structure of the heat pipe in the second embodiment. FIGS. 9A and 9B are diagrams illustrating an example of the heat pipe in the second embodiment. FIG. 9B illustrates a plan view of the heat pipe, and FIG. 9A illustrates a cross sectional view along a line A-A in FIG. 9B.

As illustrated in FIGS. 9A and 9B, a heat pipe 2 differs from the heat pipe 1 illustrated in FIGS. 1A and 1B, in that the metal layers 13 and 14 of the first embodiment are replaced by a single metal layer 25. Otherwise, the heat pipe 2 is the same as the heat pipe 1 of the first embodiment. In other words, the heat pipe 2 is an omnidirectional heat pipe having a structure in which 3 metal layers, namely, the metal layers 11, 12, and 25, are stacked. The metal layers 11, 12, and 25 are made of a material, such as stainless steel, aluminum, magnesium alloys, or the like, and are mutually bonded directly by solid-phase (or solid-state) welding.

The metal layer 25 includes a rectangular flat plate part 251 having a top surface 25*a* and a bottom surface 25*b*, and a sidewall part 252 projecting towards the metal layer 12 from an outer peripheral part of the bottom surface 25*b* of the flat plate part 251. The flat plate part 251 and the sidewall part 252 of the metal layer 25 are integrally formed to a concave shape corresponding to an opening 25*x*. The opening 25*x* of the sidewall part 252 exposes the through-holes 12*x* that are arranged in the matrix arrangement, and is formed to a frame-shape on the outer peripheral part of the bottom surface 25*b* of the flat plate part 251. A bottom surface of the sidewall part 252 of the metal layer 25 is directly bonded to an outer peripheral part of the top surface of the metal layer 12.

A total thickness $T_1$ of the metal layer 25 may be in a range of approximately 50 μm to approximately 200 μm, for example. The total thickness $T_1$ of the metal layer 25 may be the same as the thickness of each of the metal layers 11 and 12. A thickness $T_2$ of the sidewall part 252 of the metal layer 25, measured from the bottom surface 25*b* of the metal layer 25, may be approximately one-half the thickness $T_1$, for example.

The sidewall part 252 of the metal layer 25 forms a vapor layer, and the vapor-phase part 21 (illustrated in FIG. 2, for example) is surrounded by the top surface of the metal layer 12 and the bottom surface 25*b* of the metal layer 25. The vapor-phase part 21 is the region in which the vapor $C_v$, obtained by vaporizing the working fluid C, is moved from the high-temperature end to the low-temperature end.

[Method of Manufacturing Heat Pipe in Second Embodiment]

Figure 10A:
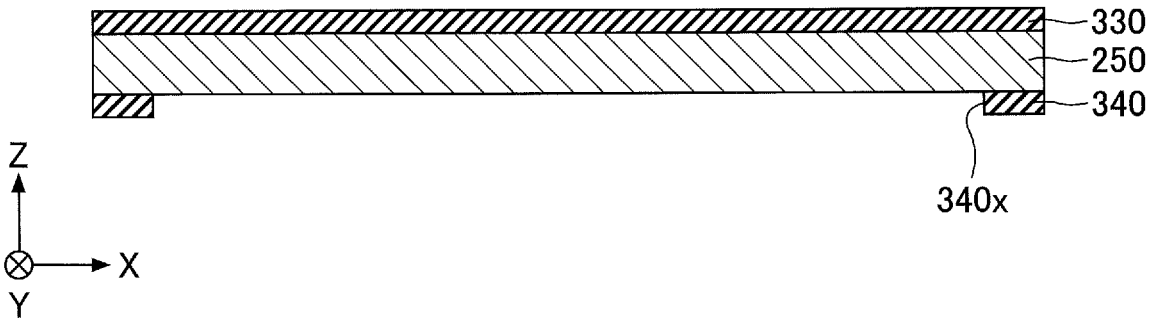
FIGS. 10A and 10B are diagrams for explaining examples of the manufacturing processes of the heat pipe in the second embodiment.
Figure 10B:
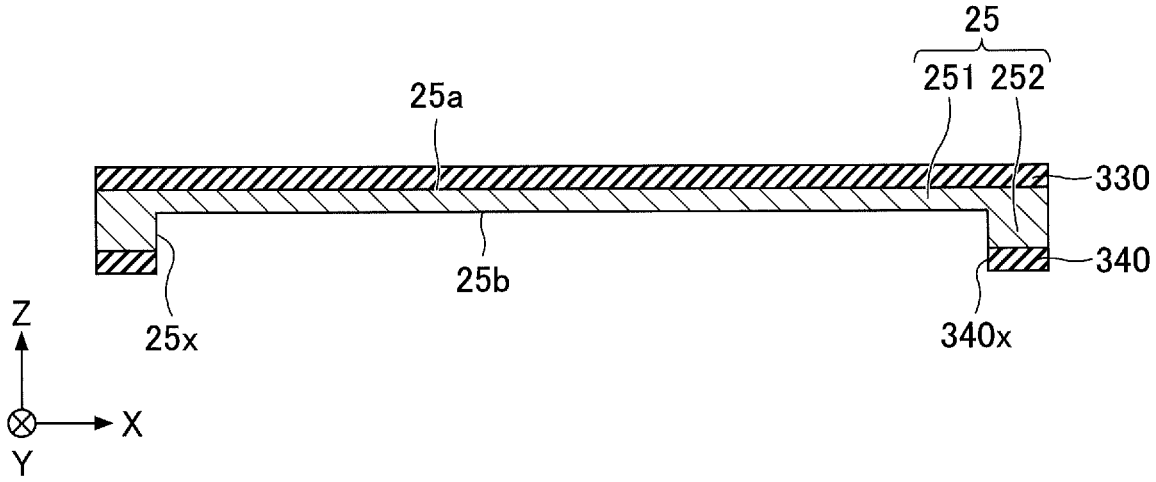

Next, a description will be given of the method of manufacturing the heat pipe in the second embodiment. FIGS. 10A and 10B are diagrams for explaining examples of manufacturing processes of the heat pipe in the second embodiment, and respectively illustrate cross sectional views corresponding to the cross sectional view of FIG. 9A.

First, the processes of the first embodiment described above with reference to FIGS. 4A and 4B are performed to form the metal layer 12.

Next, in a process illustrated in FIG. 10A, a metal sheet 250 is prepared, a continuous resist layer 330 is formed on an entire top surface of the metal sheet 250, and a frame-shaped resist layer 340 having a rectangular opening 340*x* is formed on a bottom surface of the metal sheet 250. The resist layer 340 is formed to cover a region in which the sidewall part 252 is to be formed.

The metal sheet 250 is a member that finally becomes the metal layer 25, and may be made of a material such as copper, stainless steel, aluminum, magnesium alloys, or the like, for example. The metal sheet 250 may have a thickness in a range of approximately 50 μm to approximately 200 μm, for example. The resist layers 330 and 340 may be made of a photosensitive dry film resist or the like, for example. The opening 340*x* may be formed by exposing and developing the resist layer 340.

Next, in the process illustrated in FIG. 10B, the metal sheet 250 exposed within the opening 340*x* is subjected to half-etching from the bottom surface of the metal sheet 250, to form the opening 25*x* at a central part of the bottom surface of the metal sheet 250, and to form the sidewall part 252 on the outer peripheral part of the bottom surface of the metal sheet 250 and surrounding the opening 25*x*. The half-etching of the metal sheet 250 may use an etchant such as a ferric chloride solution, for example. Thereafter, the resist layers 330 and 340 are stripped (or removed) by a stripping liquid (or remover), to form the metal layer 25 having the frame-shaped sidewall part 252 that is formed on the outer peripheral part of the bottom surface 25*b* of the flat plate part 251 and surrounds the opening 25*x*.

In FIG. 10A, the continuous resist layer 330 may be formed on the entire bottom surface of the metal sheet 250, and the frame-shaped resist layer 340 having the rectangular opening 340*x* may be formed on the top surface of the metal sheet 250. In this case, in the process illustrated in FIG. 10B, the metal sheet 250 exposed within the openings 340*x* is subjected to half-etching from the top surface of the metal sheet 250, to form the opening 25*x* at a central part of the top surface of the metal sheet 250.

Next, the metal layer 11, which is a continuous metal layer having no holes or grooves, is prepared. Then, the metal layers 11, 12, and 25 are successively stacked, pressed, and heated, to be bonded by solid-phase (or solid-state) welding, similarly to the process described above with reference to FIG. 4D. Hence, the mutually adjacent metal layers are directly bonded to each other, to thereby complete the heat pipe 2 having the vapor-phase part 21, the liquid passage part 22, and the vent part 23. Thereafter, a vacuum pump or the like is used to exhaust or purge the inside of the liquid passage part 22, the working fluid C is injected into the liquid passage part 22 from an injection port (not illustrated), and the injection port is sealed. Preferably, the metal layers 11, 12, and 25 are all made of the same material, so that the mutually adjacent metal layers can be satisfactorily bonded by the solid-phase (or solid-state) welding.

Accordingly, the metal layers 13 and 14 of the heat pipe 1 described above may be replaced by the single metal layer 25 in the case of the heat pipe 2. Because the cavities and the opening of the heat pipe 2 can be formed without using a being process or a press-forming process, it is possible to reduce the thickness of the heat pipe 2, that is the heat pipe 2 can be made thin. In a case in which each of the metal layers 11, 12, and 25 of the heat pipe 2 is formed to a thickness of 50 μm, for example, it is possible to manufacture a thin heat pipe having a total thickness of 150 μm. Effects obtainable in the second embodiment are the same as the effects obtainable in the first embodiment described above.

First Modification of Second Embodiment

In a first modification of the second embodiment, an example of the heat pipe is provided with pillars (or supports). In this first modification of the second embodiment, a repeated description of those parts that are the same as those of the first embodiment may be omitted.

Figure 11A:
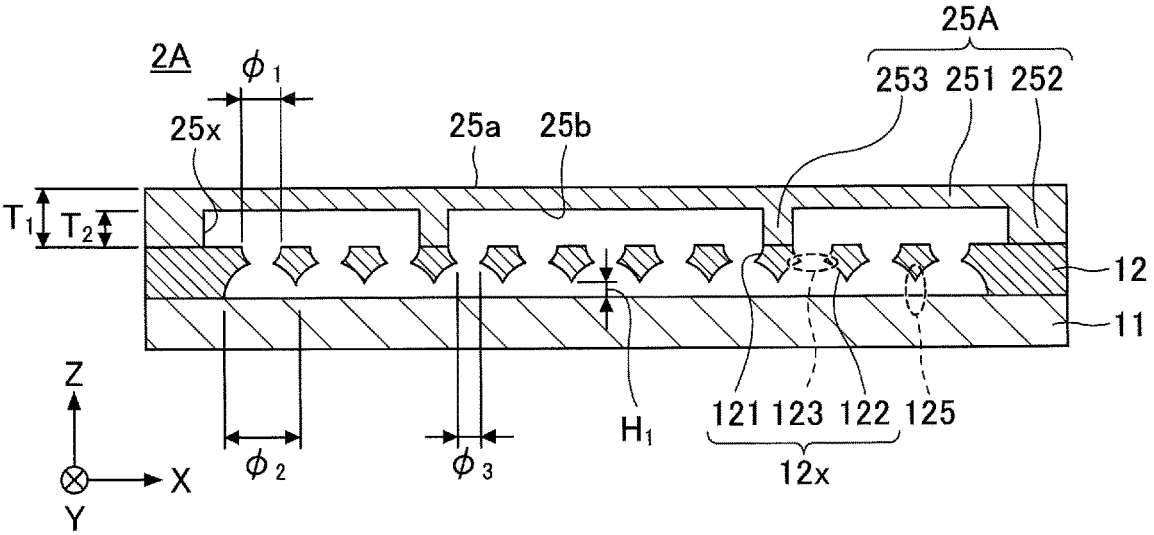
FIGS. 11A and 11B are diagrams illustrating an example of the heat pipe in a first modification of the second embodiment.
Figure 11B:
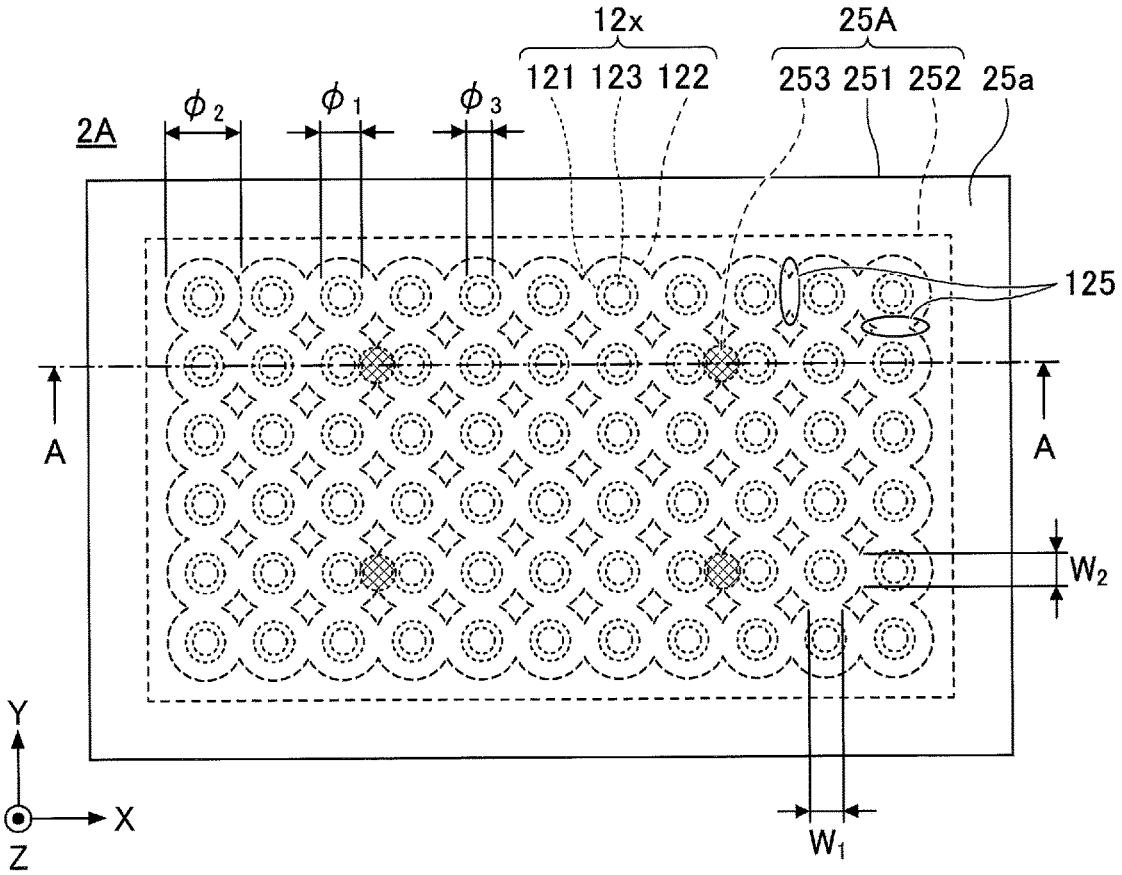

FIGS. 11A and 11B are diagrams illustrating the example of the heat pipe in the first modification of the second embodiment. FIG. 11B illustrates a plan view of the heat pipe, and FIG. 11A illustrates a cross sectional view along a line A-A in FIG. 11B.

As illustrated in FIGS. 11A and 11B, a heat pipe 2A differs from the heat pipe 2 illustrated in FIGS. 9A and 9B, in that the metal layer 25 is replaced by a metal layer 25A. Otherwise, the heat pipe 2A is the same as the heat pipe 2 of the second embodiment. In other words, the heat pipe 2A is an omnidirectional heat pipe having a structure in which 3 metal layers, namely, the metal layers 11, 12, and 25A, are stacked. The metal layers 11, 12, and 25A are made of a material, such as stainless steel, aluminum, magnesium alloys, or the like, and are mutually bonded directly by solid-phase (or solid-state) welding.

The metal layer 25A includes a rectangular flat plate part 251 having a top surface 25*a* and a bottom surface 25*b*, a sidewall part 252 projecting towards the metal layer 12 from an outer peripheral part of the bottom surface 25*b* of the flat plate part 251, and pillars 253 provided on the bottom surface 25*b* of the flat plate part 251 in a region on the inner side of the sidewall part 252. The flat plate part 251, the sidewall part 252, and the pillars 253 of the metal layer 25A are integrally formed. The sidewall part 252 includes an opening 25*x* that exposes the through-holes 12*x* that are arranged in the matrix arrangement, and is formed to a frame-shape on the outer peripheral part of the bottom surface 25*b* of the flat plate part 251. The pillars 253 project towards the metal layer 12 from the bottom surface 25*b* of the flat plate part 251 that is exposed within the opening 25*x*. In the example illustrated in FIGS. 11A and 11B, 4 pillars 253 are provided, however, the number of pillars 253 may be 1 to 3, or 5 or more. A bottom surface of the sidewall part 252 of the metal layer 25A is directly bonded to an outer peripheral part of the top surface of the metal layer 12. In addition, a bottom surface of each of the pillars 253 of the metal layer 25A is directly bonded to the top surface of the metal layer 12 at predetermined positions on the top surface of the metal layer 12.

When forming the metal layer 25A, a metal sheet 250 is prepared, for example, a continuous first resist layer is formed on an entire top surface of the metal sheet, and a second resist layer is selectively formed on a bottom surface of the metal sheet at positions where the sidewall part 252 is to be formed at the outer peripheral part and where the pillars 253 are to be formed in the region on the inner side of the sidewall part 252. The bottom surface of the metal sheet, exposed at positions where the second resist layer is not formed, is subjected to half-etching from the bottom surface of the metal sheet. As a result, the opening 25*x* at a central part of the bottom surface of the metal sheet, the sidewall part 252 on the outer peripheral part of the bottom surface of the metal sheet and surrounding the opening 25*x*, and the pillars 253 on the bottom surface of the metal sheet in the region on the inner side of the sidewall part 252, are formed by the half-etching. The half-etching of the metal sheet, that is a member that finally becomes the metal layer 25A, may use an etchant such as a ferric chloride solution, for example. Thereafter, the first and second resist layers are stripped (or removed) by a stripping liquid (or remover), to complete the metal layer 25A in which the flat plate part 251, the sidewall part 252, and the pillars 253 are integrally formed.

By providing the pillars 253 on the inner side of the frame-shaped sidewall part 252 of the metal layer 25A, it is possible to prevent the metal layer 25A from collapsing during the manufacture of the heat pipe 2A at the process illustrated in FIG. 4D when the metal layers 11, 12, and 25A are successively stacked and pressed. In addition, it is possible to prevent the vapor-phase part 21 from collapsing due to deformation of the metal layer 25A while the heat pipe 2A operates. Effects obtainable in the first modification of the second embodiment are the same as the effects obtainable in the first or second embodiment described above.

For example, each of the first embodiment and the first through fourth modifications of the first embodiment may be appropriately combined. In addition, each of the second embodiment and the first modification of the second embodiment may be appropriately combined with any of the second through fourth modifications of the first embodiment.

According to each of the embodiments described above, it is possible to provide a heat pipe that can improve the heat dissipation, and to provide a method of manufacturing such a heat pipe.

Various aspects of the subject-matter described herein may be set out non-exhaustively in the following numbered clauses:

1. A method of manufacturing a heat pipe, comprising:

forming a first metal layer forming a liquid layer configured to move a working fluid that is liquefied from vapor;

forming a second metal layer forming a vapor layer configured to move vapor of the working fluid that is vaporized; and bonding the second metal layer on a first surface of the first metal layer, wherein the forming the first metal layer includes half-etching a first metal sheet from a first surface of the first metal sheet to form a plurality of first cavities, half-etching the first metal sheet from a second surface of the first metal sheet opposite from the first surface to form a plurality of second cavities, forming first pores partially communicating with the plurality of first cavities and the plurality of second cavities, respectively, and forming second pores partially communicating side surfaces of the plurality of second cavities that are adjacent to each other, wherein the forming the second metal layer includes forming a plurality of through-holes that penetrate the second metal sheet in a direction taken along a thickness of the second metal sheet.

2. A method of manufacturing a heat pipe, comprising:

forming a first metal layer forming a liquid layer configured to move a working fluid that is liquefied from vapor;

forming a second metal layer forming a vapor layer configured to move the vapor of the working fluid that is vaporized; and bonding the second metal layer on a first surface of the first metal layer, wherein the forming the first metal layer includes half-etching a first metal sheet from a first surface of the first metal sheet to form a plurality of first cavities, half-etching the first metal sheet from a second surface of the first metal sheet opposite from the first surface to form a plurality of second cavities, forming first pores partially communicating with the plurality of first cavities and the plurality of second cavities, respectively, and forming second pores partially communicating side surfaces of the plurality of second cavities that are adjacent to each other, wherein the forming the second metal layer includes half-etching the second metal sheet from a first surface of the second metal sheet or a second surface of the second metal sheet opposite from the first surface of the second metal sheet, to form an opening, and a sidewall part provided on an outer peripheral part of the second metal sheet and surrounding the opening.

3. The method of manufacturing the heat pipe according to clause 1 or 2, wherein an area of a part of each of the plurality of first cavities opening at the first surface is smaller than an area of a part of each of the plurality of second cavities opening at the second surface.

4. The method of manufacturing the heat pipe according to any of clauses 1 to 3, wherein an inner wall defining each of the plurality of first cavities is tapered and widen towards the first surface, and an inner wall defining each of the plurality of second cavities is tapered and widen towards the second surface.

5. The method of manufacturing the heat pipe according to any of clauses 1 to 4, wherein two or more first cavities among the plurality of first cavities communicate to one of the plurality of second cavities.

Although the embodiments and modifications are numbered with, for example, "first," "second," etc., the ordinal numbers do not imply priorities of the embodiments and modifications. Many other variations and modifications will be apparent to those skilled in the art.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A heat pipe comprising:

a first metal layer having a first surface, and forming a liquid layer configured to move a working fluid that is liquefied from vapor; and a second metal layer, provided on the first surface of the first metal layer, and forming a vapor layer configured to move the vapor of the working fluid that is vaporized, wherein the first metal layer includes a plurality of first cavities caving in from the first surface of the first metal layer and arranged apart from each other, each first cavity of the plurality of first cavities caving in from the first surface towards a center part of the first metal layer in a first direction to a first bottom surface, wherein the first direction is taken along a thickness of the first metal layer and coincides with a direction in which the second metal layer is stacked on the first metal layer, a plurality of second cavities caving in from a second surface of the first metal layer, opposite to the first surface of the first metal layer, and arranged apart from each other, each second cavity of the plurality of second cavities caving in from the second surface towards the center part of the first metal layer in the first direction to a second bottom surface, a plurality of first pores linking by passageways to communicate with the plurality of first cavities and the plurality of second cavities, respectively, each first pore of the plurality of first pores linking by a passageway to communicate the first bottom surface and the second bottom surface in a plan view of the first metal layer viewed in the first direction, and a plurality of second pores linking by passageways to communicate inner walls of adjacent second cavities of the plurality of second cavities that are adjacent to each other along a second direction perpendicular to the first direction, respectively, wherein the plurality of second pores are located at positions not overlapping the plurality of first pores along each of the first direction, the second direction, and a third direction which is perpendicular to each of the first and second directions, and wherein the second metal layer has a picture-frame shape in the plan view, an inner sidewall defining an inner contour of the picture-frame shape in the plan view, and an opening defined by the inner sidewall and penetrating the second metal layer in the first direction, thereby exposing the plurality of cavities through the opening in the plan view.

2. The heat pipe according to claim 1, further comprising:

a third metal layer provided on a first surface of the second metal layer opposite from a second surface of the second metal layer in contact with the first surface of the first metal layer, and a fourth metal layer provided on the second surface of the first metal layer, wherein the plurality of first cavities, the plurality of second cavities, and the plurality of first pores form a plurality of through-holes arranged in a matrix arrangement.

3. The heat pipe according to claim 2, further comprising:

a plurality of pillars provided within the opening, between the first surface of the first metal layer and the third metal layer.

4. The heat pipe according to claim 1, wherein an area of a part of each first cavity of the plurality of first cavities opening at the first surface of the first metal layer is smaller than an area of a part of each second cavity of the plurality of second cavities opening at the second surface of the first metal layer.

5. The heat pipe according to claim 1, wherein each first cavity of the plurality of first cavities has a tapered shape defined by inner walls thereof that widen from a corresponding first pore of the plurality of first pores towards the first surface of the first metal layer, and each second cavity of the plurality of second cavities has a tapered shape defined by the inner walls thereof that widen from a corresponding first pore of the plurality of first pores towards the second surface of the first metal layer.

6. The heat pipe according to claim 1, wherein two or more first cavities of the plurality of first cavities link by passageways to communicate with one second cavity of the plurality of second cavities.

7. The heat pipe according to claim 1, wherein the plurality of first cavities include first cavities opening at the first surface of the first metal layer with mutually different areas.

8. The heat pipe according to claim 1, further comprising:

a first region having the plurality of first cavities arranged at a first density in the plan view; and a second region having the plurality of first cavities arranged at a second density lower than the first density in the plan view.

9. The heat pipe according to claim 2, further comprising:

a first region having the plurality of first cavities arranged at a first density in the plan view; and a second region having the plurality of first cavities arranged at a second density lower than the first density in the plan view.

10. The heat pipe according to claim 5, further comprising:

a first region having the plurality of first cavities arranged at a first density in the plan view; and a second region having the plurality of first cavities arranged at a second density lower than the first density in the plan view.

11. The heat pipe according to claim 1, wherein the first metal layer has a single-layer structure.

12. The heat pipe according to claim 1, wherein the inner sidewall of the second metal layer surrounds the opening in the plan view.

13. The heat pipe according to claim 1, wherein an outer contour of the picture-frame shape, defined by an outer sidewall of the second metal layer, has a rectangular shape in the plan view.

14. The heat pipe according to claim 1, wherein the opening in the second metal layer has a rectangular shape in the plan view.

* * * * *